US005396317A

United States Patent [19]

Osawa et al.

[11] Patent Number: 5,396,317

[45] Date of Patent: Mar. 7, 1995

[54] MAGNETIC PARTICLE-CONTAINING MEMBER FOR USE IN COPYING MACHINE

[75] Inventors: Izumi Osawa, Ikeda; Kenji Masaki, Ibaraki; Isao Doi, Toyonaka; Shuji Iino, Hirakata, all of Japan

[73] Assignee: Minolta Camera Kabushiki Kaisha, Osaka, Japan

[21] Appl. No.: 35,276

[22] Filed: Mar. 22, 1993

Related U.S. Application Data

[63] Continuation of Ser. No. 651,604, Feb. 6, 1991, abandoned.

[51] Int. Cl.[6] ..... G03G 15/09; G03G 21/00

[52] U.S. Cl. ..... 355/269; 355/305; 355/306; 355/251; 118/652; 118/657; 430/125

[58] Field of Search ..... 355/269, 296, 305, 306, 355/326, 251; 118/652–658; 430/125

[56] References Cited

U.S. PATENT DOCUMENTS

| | | | |
|---|---|---|---|
| 3,345,294 | 10/1967 | Cooper . | |
| 3,649,262 | 3/1972 | Cade et al. | 355/269 |
| 3,682,538 | 8/1972 | Cade et al. | 355/269 |
| 4,076,857 | 2/1978 | Kasper et al. . | |
| 4,590,140 | 5/1986 | Mitsuhashi | 430/102 |
| 4,741,982 | 5/1988 | Iino et al. . | |
| 4,801,515 | 1/1989 | Iino et al. . | |
| 4,820,603 | 4/1989 | Sakashita . | |
| 4,882,256 | 11/1989 | Osawa et al. . | |
| 4,960,668 | 10/1990 | Yoshitomi et al. . | |
| 4,963,454 | 10/1990 | Yano et al. . | |
| 4,975,214 | 12/1990 | Sakashita et al. . | |
| 5,061,593 | 10/1991 | Yoerger et al. . | |

FOREIGN PATENT DOCUMENTS

| | | |
|---|---|---|
| 50-45639 | 4/1975 | Japan . |
| 54-51844 | 4/1979 | Japan . |
| 62-34182 | 2/1987 | Japan . |

OTHER PUBLICATIONS

*Patent Abtract of Japan*, vol. 15, No. 347, (P1246), for Japanese Kokai 03-131866, Published Jun. 5, 1991.

*Patent Abstract of Japan*, vol. 15, No. 347, (P1246), for Japanese Kokai 03-131864, Published Jun. 5, 1991.

*Primary Examiner*—R. L. Moses

*Attorney, Agent, or Firm*—Burns, Doane, Swecker & Mathis

[57] ABSTRACT

This invention provides an image forming apparatus comprising:

a photosensitive member having an amorphous carbon layer on a surface thereof; and a developing device accommodating a toner for developing an electrostatic latent image formed on the surface of the photosensitive member, the toner including magnetic particles each of which has at least either of octahedron shape and irregular shape.

18 Claims, 3 Drawing Sheets

MAGNETIC PARTICLE-CONTAINING MEMBER FOR USE IN COPYING MACHINE

This application is a continuation of application Ser. No. 07/651,604, filed on Feb. 6, 1991, now abandoned.

BACKGROUND OF THE INVENTION

The present invention relates to a magnetic particle-containing member for preventing an image-flow of a photosensitive member provided with an amorphous carbon layer formed on an uppermost surface thereof.

Since the discovery of the Carlson's method, the field, to which an electrophotography is applied, has continued to make a remarkable progress and various kinds of material have been developed to be practically used also for an electrophotographic photosensitive member.

The photosensitive member serves to form an electrostatic latent image corresponding to a desired image on a surface thereof by utilizing a photoconductive function.

Various kinds of materials used in the photosensitive member have been proposed. One of them is a plasma-polymerized layer of organic compounds. The organic plasma-polymerized layer [hereinafter referred to as "amorphous carbon layer" (a-C layer)] is mainly composed of an amorphous carbon layer which is originally hard. Therefore, the amorphous carbon layer is used as a surface protective layer for various kinds of photosensitive members. The amorphous carbon layer exhibits an electric conductivity by suitably selecting manufacturing conditions, additives and the like and thus it is used as a charge-transporting layer in a photosensitive member of laminate structure comprising a charge-generating layer and the charge-transporting layer in some cases.

The photosensitive member used in the copying machine is exposed to an active gaseous atmosphere, such as ions, ozone and $NO_x$, generated from a charger during a charging process.

These active gases are adhered to a surface of the photosensitive member to influence characteristics of the photosensitive member adversely.

The amorphous carbon layer has a property of adsorbing these active gases. According to knowledges of the present inventors, the adsorption property is as follows:

When an affinity of an organic photosensitive member (OPC), the surface of which is formed of a mixture of a resin and a charge-transporting agent, to water is compared with that of a photosensitive member (a-C/OPC) having a surface protective layer (a-C) on the organic photosensitive member (OPC) to water by measuring a water contact angle, both the OPC and the a-C/OPC exhibited a water contact angle of 85° to 90° in the beginning. The OPC, however, exhibits the water contact angle of about 60° while the a-C/OPC exhibits the water contact angle of about 25° after charging and exposure is repeated about 20000 times.

This fact indicates that the amorphous carbon layer can very easily adsorb the active gases generated in a charging process.

On the other hand, the photosensitive member exhibiting the water contact angle of 40° or less adsorbs a moisture in an atmosphere on the surface thereof to reduce a surface resistance. In this case, a so-called image-flow is observed when the photosensitive member is used under a high-temperature and high-humidity environment, for example 35° C. and 85%.

In order to prevent such an image-flow, it is required to remove the active gases adsorbed on the surface every time when charged.

A technique for preventing the image-flow is disclosed in, for example, Japanese Patent Application Laid-Open No. Sho 62-34182 and the like. According to this technique, an amorphous silicon surface layer is slidingly rubbed with a toner or a blade made of a polyester resin to remove the active gases adsorbed on a surface thereof.

However, a gas adsorptive capacity of the amorphous carbon layer is remarkably higher than that of amorphous silicon, so that the surface of the amorphous carbon layer can not be sufficiently cleaned by the above described measure.

SUMMARY OF THE INVENTION

The object of the present invention is to prevent an image-flow of a photosensitive member having an amorphous carbon layer as an uppermost surface layer thereof.

The object of the present invention can be achieved by incorporating magnetic particles having an specified shape and a high hardness into a member used in a copying machine so as to slidingly rub a surface of the photosensitive member.

DETAILED DESCRIPTION OF THE PRESENT INVENTION

The present invention relates to an image forming apparatus comprising:

- a photosensitive member having an amorphous carbon layer on a surface thereof; and
- a developing device accommodating a toner for developing an electrostatic latent image formed on the surface of the photosensitive member, the toner including magnetic particles each of which has at least either of octahedron shape and irregular shape.

Any photosensitive member may be used so far as an amorphous carbon layer is formed as an upper most surface thereof. For example, a photosensitive member having an amorphous carbon layer as a charge-transporting layer at uppermost surface (disclosed in, for example, U.S. Pat. No. 4,741,982 and the like), an inorganic photosensitive member having an amorphous carbon layer as a surface protective layer (disclosed in, for example, U.S. Pat. No. 4,801,515), an organic photosensitive member having an amorphous carbon layer as a surface protective layer (disclosed in, for example, U.S. Pat. No. 4,882,256) and the like are exemplified.

In a copying process, these photosensitive members are rubbed slidingly by members, such as a toner, a carrier (in case of a two-component developer), a magnetic brush cleaner and the like.

According to the present invention, these members contain magnetic particles having an specified shape and a high hardness.

In addition, they may be brought into particular contact with the photosensitive member as a refreshing member.

The shape of the magnetic particles is preferably octahedral or irregular shape. An acicular shape and a spherical shape are undesirable.

Figure 1:
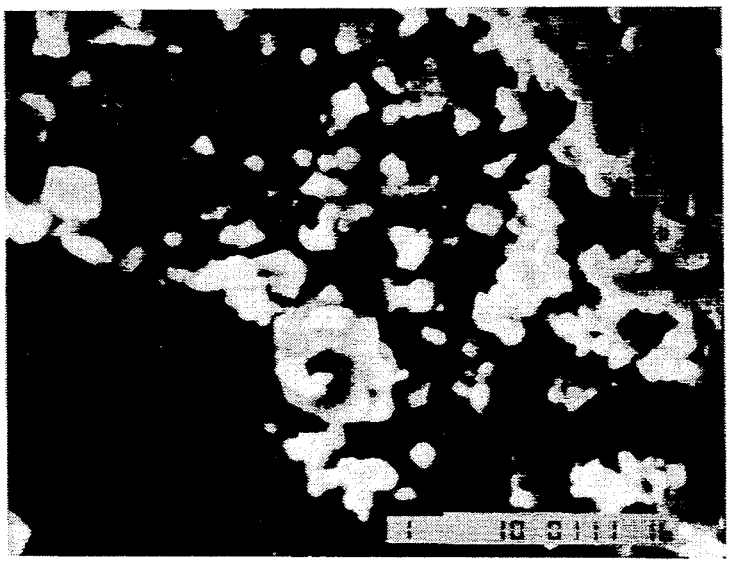
FIG. 1 is an electron microscopic photography showing a particulate structure of octahedral magnetic particles.

It is unnecessary that the respective planes of octahedrons are uniform. They may have cracks, flaws and the like. It is sufficient that eight planes, which are recognized to be flat respectively when observed in a suitable magnification, clearly exist. A particulate structure (electron microscopic photography) of the magnetic particles having an octahedral structure is shown in FIG. 1. It is found that the eight planes are not uniform due to cracks, flaws and the like in some cases but they are clearly flat.

Figure 2:
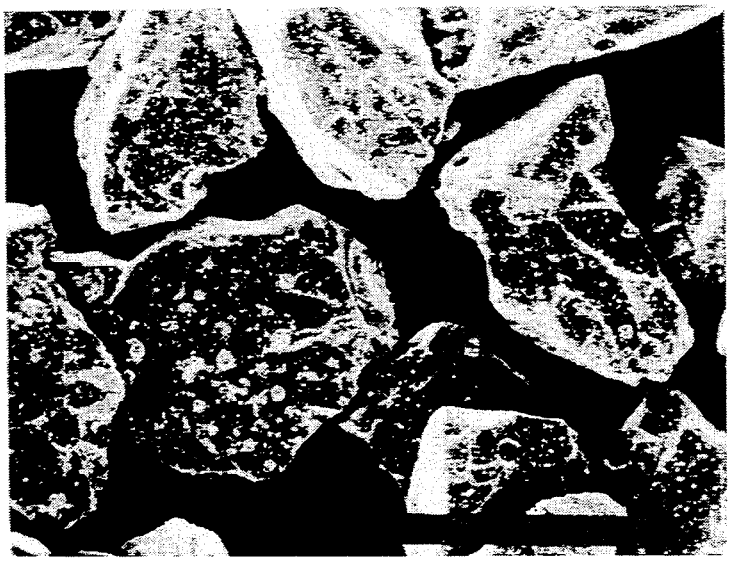
FIG. 2 is an electron microscopic photography showing a particulate structure of amorphous magnetic particles.

Irregular shape magnetic particles have shapes other than acicular shapes or spherical shapes. The irregular shapes which will be specified below, and do not include the above described octahedral shapes. A typical example of the irregular shape magnetic particles is shown in FIG. 2 (electron microscopic photography).

Figure 3:
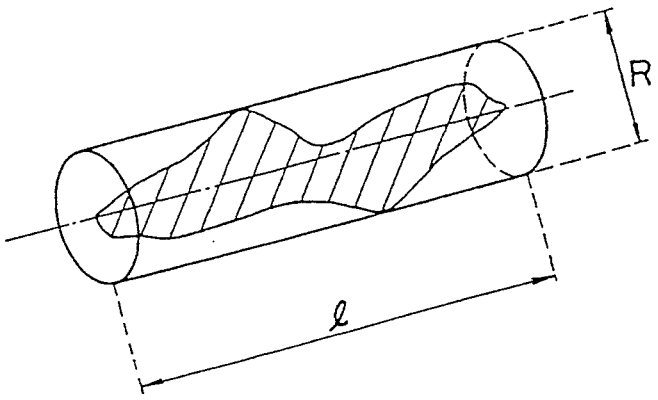
FIG. 3 is a drawing for explaining a general idea of an acicular particle.
Figure 4:
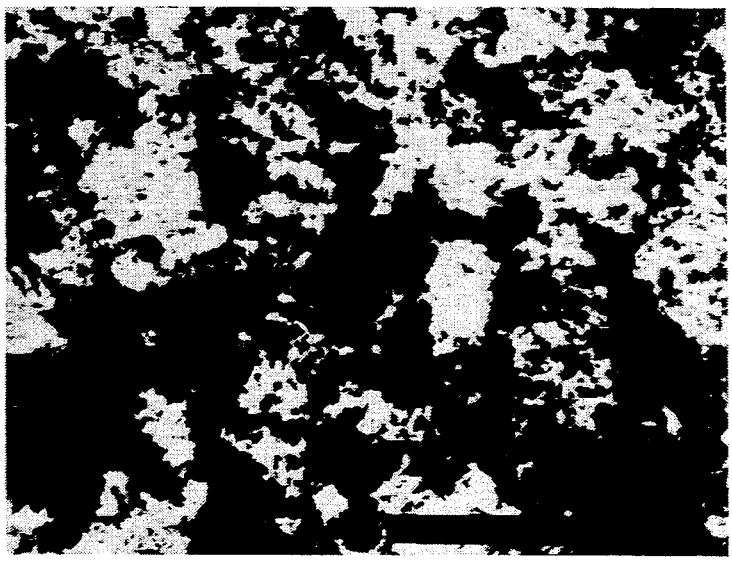
FIG. 4 is an electron microscopic photography showing a particulate structure of acicular magnetic particles.

The magnetic particles having acicular structures mean that the number of the particles having a ratio of l/R exceeding 10 (in which l is maximum length of particle and R is a diameter of a column having the longest portion of particle as a central axis, as shown in FIG. 3) occupies 80% or more on the basis of the total number of magnetic particles. An electron microscopic photography of the magnetic particles having the acicular structure is shown in FIG. 4. The acicular magnetic particles are recognized on FIG. 4 even visually.

The magnetic particles having spherical structures mean that the number of the particles having a shape coefficient SF1 expressed by the following formula smaller than 120 and a shape coefficient SF2 smaller than 110 occupies 80% or more on the basis of the total number of magnetic particles;

$$SF1=\{(\text{the maximum length})^2/(\text{an area})\}\times(\pi/4)\times 100$$

wherein the maximum length is a mean value of maximum lengths in projected images of particles; an area is a mean value of projected areas of particles.

$$SF2=\{(\text{a circumferential length})^2/(\text{an area})\}\times\{100/(4\pi)\}$$

wherein a circumferential length is a mean value of circumferential lengths of projected images of particles; an area is a mean value of projected areas of particles.

Figure 5:
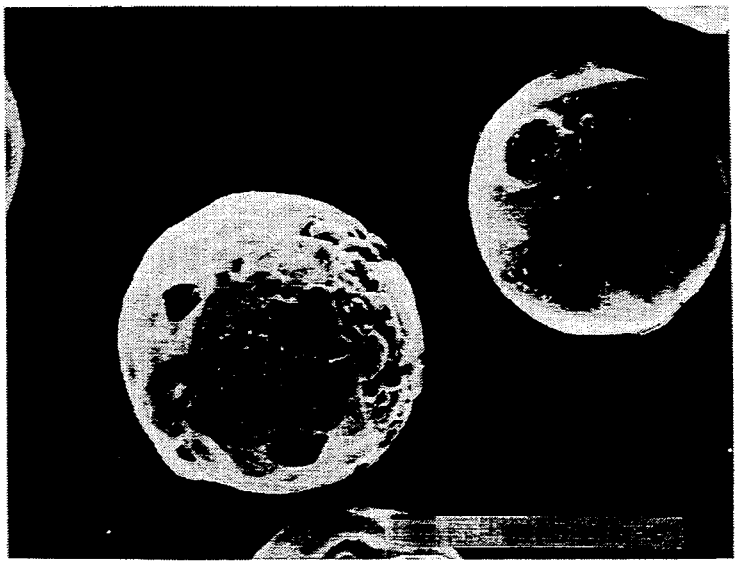
FIG. 5 is an electron microscopic photography showing a particulate structure of spherical magnetic particles.

An electron microscopic photography of the magnetic particles having a spherical structure is shown in FIG. 5. The spherical magnetic particles are recognized on FIG. 5 even visually.

A toner as the magnetic particle-containing member according to the present invention will be described below.

It is important for an application of the present invention in the form of toner that magnetic particles having the above described octahedral structure or amorphous structure are exposed on a surface of the toner. In the case where such the toner is applied to a developing method, a cascade developing method and the like, of an electrostatic latent image formed on the surface of the photosensitive member, in which the toner is used so as to slidingly rub the surface of the photosensitive member, or, in the case where the toner is applied to a cleaning method, such as a blade cleaning method, in which a blade is pressed against the surface of the photosensitive member to which toner particles adhered in order to scrape off the toner, a fur brush cleaning method, in which the toner is struck down by means of a brush and the like, the toner particles is result in rubbing slidingly the surface of the photosensitive member. As a result, the magnetic particles exposed on the surface of the toner serve to mechanically scrape off ions, ozone, $NO_x$ and the like adhered to the surface of the photosensitive member.

In this time, when the magnetic particles have the octahedral shape or the irregular shape, substances adhered to the surface of the photosensitive member are effectively scraped off by a face contact or a crest line contact of the magnetic particles with the photosensitive member in case of the octahedral shape and by a multi-point contact of the magnetic particles with the photosensitive member in case of the irregular shape. When the magnetic particles have the spherical or acicular shape, the magnetic particles are merely brought into point contact with the photosensitive member, so that the substances adhered to the surface of the photosensitive member can not be sufficiently scraped off. There are known a toner containing conventional magnetic particles and a toner without containing magnetic particles, which are applied to various kinds of developing methods. In the present invention, the octahedral or irregular shape magnetic particles may be incorporated into the toner containing the conventional magnetic particles in place of the conventionally used magnetic particles and also into the conventional toner containing no magnetic particle.

Other additives, for example,.colorants, charge-controlling agents, wax releasing agents, conductivity-regulating agents, fluidizing agents and the like or toner-forming resins, may be used in the same quantities as those in the conventional toner.

It is preferable that the magnetic particles have a size of about 0.01 to 1.0 μm. If the particle size is less than 0.01 μm, the magnetic particles are apt to be cohered and the resultant cohered products slidingly rub the photosensitive member, so that the cohered products are broken to make the above described scraping-off effect insufficient. In addition, if the particle size is larger than 1.0 μm, contacting chances of the magnetic particles with the photosensitive member are reduced, so that the scraping-off effect is made insufficient also in this case.

It is preferable that the magnetic particles are added into a so-called binder-type toner, in which the magnetic particles are dispersed in resin, in a quantity of about 0.1 to 40 parts by weight based on 100 parts by weight of the resin. If the magnetic particles are added in a quantity less than 0.1 parts by weight, the refreshing effect for the amorphous carbon layer becomes insufficient to generate an image-flow.

If the magnetic particles are added in a quantity larger than 40 parts by weight, the magnetic properties become very strong to bring about reduction of chargeability, so that toner particles come to adhere to the portions where electrostatic latent images are not formed on the photosensitive member.

In particular, in the case where a two component developing method is applied, it is preferable that the magnetic particles are added in a slightly smaller quantity to an extent of 0.1 to 30 parts by weight because of tendency to reduce the developing characteristics, while, in the case where a single-component developing method is applied, it is preferable that the magnetic particles are added in a slightly larger quantity to an extent of 10 to 40 parts by weight so as to increase toner transportability on a developing sleeve and efficiently bring the toner into contact with the surface of the photosensitive member.

Such a binder-type toner can be produced by a known kneading and grinding method, a suspension polymerization method and the like.

In a composite-type toner comprising a plurality of layers, it is preferable that the magnetic particles are contained in an uppermost layer in the same quantity as above described because of the same reason as above described.

Such a composite-type toner can be produced by a known microcapsulization method, the mechanical stress method and the like.

Then, a carrier will be described as a magnetic particle-containing member according to the present invention.

It is important for an application of the present invention in the form of carrier that magnetic particles having the octahedral structure or irregular shape structure are exposed on a surface of the carrier because of the same reason as in its application to the toner.

The present invention can be applied to the conventional kinds of carriers and the octahedral or irregular shape magnetic particles are contained in the carrier in place of the conventional magnetic particles. Other additives, for example charge-controlling agents, waxes, fluidizing agents, conductivity-regulating agents and binder resins for use in carrier may be used in the same quantity as in the conventional carrier.

When the magnetic particles are contained in the carrier, it is preferable that the magnetic particles have a particle size of about 0.01 to 200 μm. If the particle size is smaller than 0.01 μm, the magnetic particles are apt to be cohered in the same manner as in the toner. In addition, if the particle size is larger than an appointed degree, the contacting chances of the magnetic particles with the photosensitive member are reduced in the same manner as in the toner to make the scraping-off effect insufficient. However, the carrier can contain a large amount of magnetic particles differently from the toner, so that the carrier can contain magnetic particles having particle size larger than that of magnetic particles contained in the toner, concretely about 200 μm.

It is preferable that the magnetic particles are added in a so-called binder-type carrier with the magnetic particles dispersed in resin in a quantity of about 200 to 600 parts by weight based on 100 parts by weight of the resin. If the magnetic particles are added in a quantity less than 200 parts by weight, a suitable magnetic force can not be obtained to produce scattering of carrier. If the magnetic particles are added in a quantity larger than 600 parts by weight, the carrier becomes fragile to be cracked due to decrease of a quantity of resin. Also this leads to scattering of carrier.

Such a binder-type carrier can be produced by a known kneading and grinding method or a suspension polymerization method.

In a composite-type carrier comprising plural layers, it is preferable that the magnetic particles are contained in an uppermost layer in the same quantity as above described because of the same reason as above described.

Such a composite-type carrier can be produced by a known microcapsulization method, a spray drying method, a mechanical stress method and the like.

Next, in the case where the magnetic particle-containing member according to the present invention is applied to magnetic brush cleaner, it is sufficient that octahedral or irregular shape magnetic particles are used in place of magnetic particles contained in the conventional magnetic brush cleaner.

Other additives, for example charge-controlling agents, waxes, fluidizing agents, conductivity-regulating agents and binder resins may be used in the same quantity as in the conventional magnetic brush cleaner.

When the magnetic particles are contained in the magnetic brush cleaner, it is preferable that the magnetic particles have a particle size of about 0.01 to 200 μm.

When the magnetic particles are added in a so-called binder-type cleaner, it is preferable that the magnetic particles are dispersed in resin in a quantity of about 200 to 600 parts by weight based on 100 parts by weight of the resin. If the magnetic particles are added in a quantity less than 200 parts by weight, a suitable magnetic force can not be obtained to produce scattering of cleaner. If the magnetic particles are added in a quantity larger than 600 parts by weight, the cleaner becomes fragile to be cracked due to decrease of a quantity of resin. Also this leads to scattering of cleaner.

Such a magnetic brush cleaner can be produced by a known kneading and grinding method and a suspension polymerization method.

EXAMPLES

Preparation of Organic Photosensitive Member Having Amorphous Carbon Layer as Surface Protective Layer (Formation of Charge-generating Layer)

A bisazo compound expressed by the following formula Ia of 2 parts by weight, a polyester resin (V-500; made by Toyo Boseki K.K.) of 1 part by weight and methyl ethyl ketone of 100 parts by weight were mixed and dispersed for 24 hours in a ball mill. The obtained dispersion was applied by dipping to a cylindrical aluminum substrate having diameter of 80 mm and length of 330 mm followed by drying to form a charge-generating layer having layer-thickness of 3000 Å.

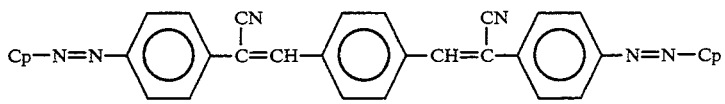

[Ia]

-continued

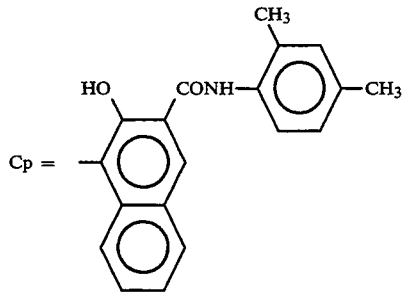

Formation of Charge-transporting Layer

Subsequently, a styryl compound expressed by the following formula Ib of 10 parts by weight and methylmethacrylate resin (BR-85; made by Mitsubishi Reyon K.K.) of 10 parts by weight were dissolved in tetrahydrofuran of 80 parts by weight. The obtained solution was applied to the charge-generating layer followed by drying to form a charge-transporting layer having layer-thickness of 20 μm. Thus, an organic photosensitive layer was obtained.

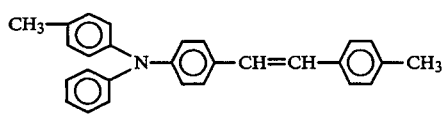

[Ib]

Formation of Surface Protective Layer

Subsequently, an amorphous carbon layer having layer thickness of about 1000 Å was formed as a surface protective layer on the charge-transporting layer under the following conditions in a plasma CVD apparatus disclosed in U.S. Pat. No. 4,882,256.

| [Plasma Conditions] Raw material gases and flow rates thereof | |
|---|---|
| Hydrogen gas | 300 [sccm] |
| Butadiene gas | 15 [sccm] |
| Internal pressure of vacuum tank | 0.3 [Torr] |
| Substrate temperature | 50 [°C.] |
| Discharge frequency | 80 [KHz] |
| Discharge electric power | 150 [W] |
| Discharge time | 3.5 [min] |

EXAMPLE 1

Production of Toner

| | Parts by weight |
|---|---|
| Styrene-acrylic resin (softening point: 132° C.; glass transition point: 62° C.) | 100 |
| Carbon black MA #8 (made by Mitsubishi Kasei Kogyo K.K.) | 5 |
| Charge-controlling agent Nigrosine Base EX (made by Oriento Kagaku K.K.) | 5 |
| Magnetic particles (octahedral) EPT-1000 (made by Toda Kogyo K.K.) | 5 |

The above described materials were sufficiently mixed in a Henschel mixer. The obtained mixture was kneaded in a biaxial extruder and then cooled followed by being pulverized roughly. The pulverized products were further pulverized in a jet grinder and then classified in an air classifier to obtain a positively chargeable toner having a mean particle size of 13.2 μm.

EXAMPLES 2, 3, 14

Comparative Examples 1, 2

(Toner)

A toner was prepared in the same manner as in Example 1 excepting that the magnetic particles were used in the following quantities.

| | Magnetic particles (parts by weight) |
|---|---|
| Comparative Example 1 | 0 |
| Example 2 | 0.1 |
| Example 1 | 5 |
| Example 14 | 30 |
| Example 3 | 40 |
| Comparative Example 2 | 80 |

EXAMPLE 4

(Toner)

| | Parts by weight |
|---|---|
| Polyester resin (softening point: 123° C.; glass transition point: AV23, OHV40) | 100 |
| Carbon black MA #8 (made by Mitsubishi Kasei Kogyo K.K.) | 5 |
| Charge-controlling agent Bontron S-34 (made by Oriento Kagaku K.K.) | 5 |
| Magnetic particles (irregular shape) MFP-2 (made by TDK K.K.) | 5 |

The above described materials were sufficiently mixed in a Henschel mixer. The obtained mixture was kneaded in a biaxial extruder and then cooled followed by being pulverized roughly. The pulverized products were further pulverized in a jet grinder and then classified in an air classifier to obtain a negatively chargeable toner having a mean particle size of 12.9 μm.

EXAMPLES 5, 6, 15

Comparative Examples 3, 4

(Toner)

A toner was prepared in the same manner as in Example 4 excepting that the magnetic particles were used in the following quantities.

| | Magnetic particles (parts by weight) |
|---|---|
| Comparative Example 3 | 0 |

-continued

| | Magnetic particles (parts by weight) |
|---|---|
| Example 5 | 0.1 |
| Example 4 | 5 |
| Example 15 | 30 |
| Example 6 | 40 |
| Comparative Example 4 | 80 |

Comparative Examples 5, 6, 7 (Toner)

A toner was prepared in the same manner as in Examples 1, 2, 3 excepting that spherical magnetic particles (MAT-305 HD; made by Toda Kogyo K.K.) were used to obtain a positively chargeable toner.

Comparative Examples 8, 9, 10 (Toner)

A toner was prepared in the same manner as in Examples 1, 2, 3 excepting that acicular magnetic particles (MAT-740; made by Toda Kogyo K.K.) were used to obtain a positively chargeable toner.

EXAMPLE 7

(Carrier)

| Ingredient | Parta by weight |
|---|---|
| Polyester resin (softening point: 123° C.; glass transition point: 65° C., AV 23, OHV 40) | 100 |
| Inorganic magnetic particles (octahedral)(EPT-1000; made by Toda Kogyo K.K.) | 500 |
| Carbon black (MA #8; made by Mitsubishi Kasei K.K.) | 2 |

The above described materials were sufficiently mixed and pulverized roughly in a Henschel mixer. The obtained mixture was fused and kneaded in a kneading extruder set at 180° C. at a cylinder portion and 170° C. at a cylinder head portion and then cooled followed by being finely pulverized in a jet mill. The pulverized products were classified in a classifier to obtain a magnetic carrier having a mean particle size of 55 μm.

EXAMPLES 8, 9,

Comparative Examples 11, 12

(Carrier)

A carrier was prepared in the same manner as in Example 7 excepting that the magnetic particles were used in the following quantities.

| | Magnetic particles (parts by weight) |
|---|---|
| Comparative Example 11 | 100 |
| Example 8 | 200 |
| Example 7 | 500 |
| Example 9 | 600 |
| Comparative Example 12 | 800 |

EXAMPLES 10 TO 12

Comparative Examples 13 to 20

(Carrier)

A carrier was prepared in the same manner as in Example 7 excepting that the magnetic particles were used in the following quantities.

| Magnetic particles parts by weight | (irregular shape) MFP-2 (made by TDK K.K.) | (spherical) MAT-305HD (made by Toda Kogyo K.K.) | (acicular) MAT-740 (made by Toda Kogyo K.K.) |
|---|---|---|---|
| 100 | C.E. 13 | — | — |
| 200 | Example 10 | C.E. 15 | C.E. 18 |
| 500 | Example 11 | C.E. 16 | C.E. 19 |
| 600 | Example 12 | C.E. 17 | C.E. 20 |
| 800 | C.E. 14 | — | — |

C.E. : Comparative Example

EXAMPLE 13

(Magnetic brush cleaner)

A cleaner of a copying machine EP490Z (made by Minolta Camera K.K.) on the market was reconstructed into a magnetic brush cleaner and the carrier produced in Example 7 was used as particles for use in the magnetic brush cleaner to conduct the evaluation.

Evaluation Method

In the case where the particles according to the present invention were used as a toner, the carrier shown in Comparative Example 16 containing 500 parts of the spherical magnetic particles having no refreshing effect was used so as to observe differences in effect depending upon differences of the magnetic particles in shape.

In the case where the particles according to the present invention were used as a carrier, the toner (containing the spherical magnetic particles of 5 parts) shown in Comparative Example 5 was used to observe differences in effect depending upon differences of the magnetic particles in shape.

The organic photosensitive member, the toner and the carrier obtained in the above described manner were subjected to the copying test in a copying machine on the market under the following conditions:

Conditions:

Copying machine EP490Z (made by Minolta Camera K.K.)

Transfer paper A4 size 64 g/m$^2$

Environment 20° C., 65%

A manuscript of A4 with letters of 8 points printed all over the surface thereof was copied under high-temperature and high-humidity environment of 35° C. and 85% to evaluate an image-flow on the copied image at the beginning and after copying every 10000, 20000, 30000, 40000 and 50000 times.

The evaluation was conducted as follows and the results were shown by ○, Δ and x.

1. An image-concentration of a letter portion of the copied image was measured all over the surface of the A4 size paper by use of the following measuring apparatus.
   Name of the measuring apparatus: Micro Densitometer
   Maker: Konishiroku Shashin Kogyo K.K.
   Type of the measuring apparatus: Sakura Densitometer
   Maker: Konishiroku Shashin Kogyo K.K.
   Type of the measuring apparatus: Sakura Densitometer Model-PDM5 Type-BR
   Feed speed in the X-axial direction: 1 mm/sec
   Feed width in the Y-axial direction: 0.5 mm/scan
2. The following evaluation standards were applied to the image-concentration of the letter portion.

○: The image-concentration of the letter portion of 1.2 or more was obtained all over the surface.

Δ: The image-concentration of the letter portion of 1.2 or more could not be obtained all over the surface because of a partial image-flow but the image-concentration of the letter portion of 0.8 or more was obtained all over the surface.

x: The image-concentration of the letter portion of 0.8 or more could not be obtained all over the surface because of the image-flow.

In addition, as for Examples 4, 5, 6, 15 and Comparative Examples 3, 4, a polarity of transfer CHG of EP490Z was changed and a negative-type manuscript was used to conduct the evaluation by the so-called reversal development.

The results are shown in Table 1.

TABLE 1

| | Use | Kind of Magnetic Particles | Quantity of Magnetic Particles (parts by weight) based on 100 parts by weight of Resin | Durability test with respect to copy Rank of Image-Flow (35° C., 85%) beginning | 10K | 20K | 30K | 40K | 50K | Result Evaluation | Reason |
|---|---|---|---|---|---|---|---|---|---|---|---|
| C.E. 1 | Toner | Octahedral | 0 | o | Δ | x | x | x | x | Generation of image-flow | Because of Absence of Magnetic Particles |
| EX. 2 | " | " | 0.1 | o | o | o | o | o | o | Good | |
| EX. 1 | " | " | 5 | o | o | o | o | o | o | Good | |
| EX. 14 | " | " | 30 | o | o | o | o | o | o | Good | |
| EX. 3 | " | " | 40 | o | o | o | o | o | o | Good (slightly reduced Concentration) | Slightly reduced developing characteristics |
| C.E. 2 | " | " | 80 | o | o | o | o | o | o | But the image concentration was reduced | Reduced Developing Characteristics |
| C.E. 3 | Toner | Irregular shape | 0 | o | o | Δ | x | x | x | Generation of image-flow | Because of Absence of Magnetic Particles |
| EX. 5 | " | " | 0.1 | o | o | o | o | o | o | Good | |
| EX. 4 | " | " | 5 | o | o | o | o | o | o | Good | |
| EX. 15 | " | " | 30 | o | o | o | o | o | o | Good | |
| EX. 6 | " | " | 40 | o | o | o | o | o | o | Good (slightly reduced Concentration) | Slightly reduced developing characteristics |
| C.E. 4 | " | " | 80 | o | o | o | o | o | o | But the image concentration was reduced | Reduced Developing Characteristics |
| C.E. 6 | Toner | Spherical | 0.1 | o | x | x | x | x | x | Generation of image-flow | Unsuitable shape of Magnetic Particles |
| C.E. 5 | " | " | 5 | o | x | x | x | x | x | Generation of image-flow | Unsuitable shape of Magnetic Particles |
| C.E. 7 | " | " | 40 | o | Δ | x | x | x | x | Generation of image-flow | Unsuitable shape of Magnetic Particles |
| C.E. 9 | Toner | Acicular | 0.1 | o | x | x | x | x | x | Generation of image-flow | Unsuitable shape of Magnetic Particles |
| C.E. 8 | " | " | 5 | o | Δ | x | x | x | x | Generation of image-flow | Unsuitable shape of Magnetic Particles |
| C.E. 10 | " | " | 40 | o | Δ | x | x | x | x | Generation of image-flow | Unsuitable shape of Magnetic Particles |
| C.E. 11 | Carrier | Octahedral | 100 | o | o | o | o | o | o | But, carrier was scattered | Because of the reduced holding power |
| EX. 8 | " | " | 200 | o | o | o | o | o | o | Good | |
| EX. 8 | " | " | 500 | o | o | o | o | o | o | Good | |
| EX. 9 | " | " | 600 | o | o | o | o | o | o | Good | |
| C.E. 12 | " | " | 800 | o | o | o | o | o | o | But, carrier was scattered | Because of the Cracked carrier |
| C.E. 13 | Carrier | Irregular Shape | 100 | o | o | o | o | o | o | But, carrier was scattered | Because of the reduced holding power |
| EX. 10 | " | " | 200 | o | o | o | o | o | o | Good | |
| EX. 11 | " | " | 500 | o | o | o | o | o | o | Good | |
| EX. 12 | " | " | 600 | o | o | o | o | o | o | Good | |
| C.E. 14 | " | " | 800 | o | o | o | o | o | o | But, carrier was scattered | Because of the Cracked carrier |
| C.E. 15 | Carrier | Spherical | 200 | o | x | x | x | x | x | Generation of image-flow | Unsuitable shape of Magnetic Particles |
| C.E. 16 | " | " | 500 | o | Δ | x | x | x | x | Generation of image-flow | Unsuitable shape of Magnetic Particles |
| C.E. 17 | " | " | 600 | o | Δ | x | x | x | x | Generation of image-flow | Unsuitable shape of Magnetic Particles |
| C.E. 18 | Carrier | Acicular | 200 | o | Δ | x | x | x | x | Generation of image-flow | Unsuitable shape of Magnetic Particles |
| C.E. 19 | " | " | 500 | o | Δ | x | x | x | x | Generation of image-flow | Unsuitable shape of Magnetic Particles |
| C.E. 20 | " | " | 600 | o | Δ | Δ | x | x | x | Generation of image-flow | Unsuitable shape of Magnetic Particles |
| EX. 13 | Cleaner | Octahedral | 500 | o | o | o | o | o | o | Good | |

C.E.: Comparative Example
EX.: Example

It can be well understood from Table 1 that the sliding rub by the particles containing the octahedral or irregular shape magnetic particles has an effect of preventing the image-flow from generating under high-temperature and high-humidity condition in the copying test.

Developing Characteristics and Scattering of Toner or Carrier

Also the developing characteristics and a quantity of the toner or the carrier scattered were evaluated in the following manner:

The copying was conducted in the same manner as in the evaluation of the image-flow excepting that the environment was set at 20° C. and 65%.

(Developing Characteristics)

A concentration of a letter portion on the copy was measured by the use of a micro densitometer in the same manner as in the evaluation of the image-flow to rank by ○, Δ and x in the following manner.

| Image concentration | Rank |
|---|---|
| 1.2 or more | ○ |
| Not less than 0.8 but less than 1.2 | Δ |
| Less than 0.8 | x |

(Quantity of Scattered Carrier)

The number of particles adhered to originally white portions other than letter portions, on the copy was counted by the microscopic observation to rank in the following manner.

The observation was conducted at a magnification of 75 with randomly extracting 20 fields of view.

| Number of scattered particles | Rank |
|---|---|
| 0 to 2/cm$^2$ | ○ |
| 3 to 20/cm$^2$ | Δ |
| 21/Cm$^2$ or more | x |

The results are shown in Table 2

TABLE 2

| | Use | Kind of Magnetic Particles | Quantity of Magnetic Particles (parts by weight) based on 100 parts by weight of Resin | Durability test with respect to copy Rank of Image Concentration (20° C., 65%) | | | | | | Durability test with respect to copy Rank of Scattered Particles (20° C., 65%) | | | | | |
|---|---|---|---|---|---|---|---|---|---|---|---|---|---|---|---|
| | | | | beginning | 10K | 20K | 30K | 40K | 50K | beginning | 10K | 20K | 30K | 40K | 50K |
| C.E. 1 | Toner | Octahedral | 0 | ○ | ○ | ○ | ○ | ○ | ○ | Δ | Δ | Δ | Δ | Δ | Δ |
| EX. 2 | " | " | 0.1 | ○ | ○ | ○ | ○ | ○ | ○ | ○ | ○ | ○ | ○ | ○ | ○ |
| EX. 1 | " | " | 5 | ○ | ○ | ○ | ○ | ○ | ○ | ○ | ○ | ○ | ○ | ○ | ○ |
| EX. 14 | " | " | 30 | ○ | ○ | ○ | ○ | ○ | ○ | ○ | ○ | ○ | ○ | ○ | ○ |
| EX. 3 | " | " | 40 | Δ | Δ | Δ | Δ | Δ | Δ | ○ | ○ | ○ | ○ | ○ | ○ |
| C.E. 2 | " | " | 80 | x | x | x | x | x | x | ○ | ○ | ○ | ○ | ○ | ○ |
| C.E. 3 | Toner | Irregular shape | 0 | ○ | ○ | ○ | ○ | ○ | ○ | Δ | Δ | Δ | Δ | Δ | Δ |
| EX. 5 | " | Irregular shape | 0.1 | ○ | ○ | ○ | ○ | ○ | ○ | ○ | ○ | ○ | ○ | ○ | ○ |
| EX. 4 | " | Irregular shape | 5 | ○ | ○ | ○ | ○ | ○ | ○ | ○ | ○ | ○ | ○ | ○ | ○ |
| EX. 15 | " | Irregular shape | 30 | ○ | ○ | ○ | ○ | ○ | ○ | ○ | ○ | ○ | ○ | ○ | ○ |
| EX. 6 | " | Irregular shape | 40 | Δ | Δ | Δ | Δ | Δ | Δ | ○ | ○ | ○ | ○ | ○ | ○ |
| C.E. 4 | " | Irregular shape | 80 | x | x | x | x | x | x | ○ | ○ | ○ | ○ | ○ | ○ |
| C.E. 6 | Toner | Spherical | 0.1 | ○ | ○ | ○ | ○ | ○ | ○ | ○ | ○ | ○ | ○ | ○ | ○ |
| C.E. 5 | " | " | 5 | ○ | ○ | ○ | ○ | ○ | x | ○ | ○ | ○ | ○ | ○ | ○ |
| C.E. 7 | " | " | 40 | Δ | Δ | Δ | Δ | Δ | Δ | ○ | ○ | ○ | ○ | ○ | ○ |
| C.E. 9 | Toner | Acicular | 0.1 | ○ | ○ | ○ | ○ | ○ | ○ | ○ | ○ | ○ | ○ | ○ | ○ |
| C.E. 8 | " | " | 5 | ○ | ○ | ○ | ○ | ○ | ○ | ○ | ○ | ○ | ○ | ○ | ○ |
| C.E. 10 | " | " | 40 | Δ | Δ | Δ | Δ | Δ | Δ | ○ | ○ | ○ | ○ | ○ | ○ |
| C.E. 11 | Carrier | Octahedral | 100 | ○ | ○ | ○ | ○ | ○ | ○ | Δ | Δ | Δ | Δ | Δ | Δ |
| EX. 8 | " | " | 200 | ○ | ○ | ○ | ○ | ○ | ○ | ○ | ○ | ○ | ○ | ○ | ○ |
| EX. 7 | " | " | 500 | ○ | ○ | ○ | ○ | ○ | ○ | ○ | ○ | ○ | ○ | ○ | ○ |
| EX. 9 | " | " | 600 | ○ | ○ | ○ | ○ | ○ | ○ | ○ | ○ | ○ | ○ | ○ | ○ |
| C.E. 12 | " | " | 800 | ○ | ○ | ○ | ○ | ○ | ○ | Δ | Δ | Δ | Δ | Δ | Δ |
| C.E. 13 | Carrier | Irregular shape | 100 | ○ | ○ | ○ | ○ | ○ | ○ | Δ | Δ | Δ | Δ | Δ | Δ |
| EX. 10 | " | Irregular shape | 200 | ○ | ○ | ○ | ○ | ○ | ○ | ○ | ○ | ○ | ○ | ○ | ○ |
| EX. 11 | " | Irregular shape | 500 | ○ | ○ | ○ | ○ | ○ | ○ | ○ | ○ | ○ | ○ | ○ | ○ |
| EX. 12 | " | Irregular shape | 600 | ○ | ○ | ○ | ○ | ○ | ○ | ○ | ○ | ○ | ○ | ○ | ○ |
| C.E. 14 | " | Irregular shape | 800 | ○ | ○ | ○ | ○ | ○ | ○ | Δ | Δ | Δ | Δ | Δ | Δ |
| C.E. 15 | Carrier | Spherical | 200 | ○ | ○ | ○ | ○ | ○ | ○ | ○ | ○ | ○ | ○ | ○ | ○ |
| C.E. 16 | " | " | 500 | ○ | ○ | ○ | ○ | ○ | ○ | ○ | ○ | ○ | ○ | ○ | ○ |
| C.E. 17 | " | " | 600 | ○ | ○ | ○ | ○ | ○ | ○ | ○ | ○ | ○ | ○ | ○ | ○ |
| C.E. 18 | Carrier | Acicular | 200 | ○ | ○ | ○ | ○ | ○ | ○ | ○ | ○ | ○ | ○ | ○ | ○ |
| C.E. 19 | " | " | 500 | ○ | ○ | ○ | ○ | ○ | ○ | ○ | ○ | ○ | ○ | ○ | ○ |
| C.E. 20 | " | " | 600 | ○ | ○ | ○ | ○ | ○ | ○ | ○ | ○ | ○ | ○ | ○ | ○ |

TABLE 2-continued

| | Use | Kind of Magnetic Particles | Quantity of Magnetic Particles (parts by weight) based on 100 parts by weight of Resin | Durability test with respect to copy Rank of Image Concentration (20° C., 65%) | | | | | | Durability test with respect to copy Rank of Scattered Particles (20° C., 65%) | | | | | |
|---|---|---|---|---|---|---|---|---|---|---|---|---|---|---|---|
| | | | | beginning | 10K | 20K | 30K | 40K | 50K | beginning | 10K | 20K | 30K | 40K | 50K |
| EX. 13 | Cleaner | Octahedral | 500 | ○ | ○ | ○ | ○ | ○ | ○ | ○ | ○ | ○ | ○ | ○ | ○ |

C.E.: Comparative Example
EX.: Example

What is claimed is:

1. An image forming apparatus comprising:

a photosensitive member having an amorphous carbon layer on an outer surface thereof; and a developing device accommodating a toner for developing an electrostatic latent image formed on the surface of the photosensitive member, said toner comprising a binder resin, a colorant and minute particles each of which has a size of 1.0 μm or less and at least one of an octahedron shape and an irregular shape, having a ratio of 1/R exceeding 10 in less than 80% of the particles on the basis of the total number of minute particles wherein 1 is the maximum length of a particle and R is a diameter of a column having the longest portion of the particle as a central axis, and having a shape coefficient SF1 smaller than 120 and a shape coefficient SF2 smaller than 110 in less than 80% of the particles on the basis of the total number of minute particles wherein $SF1=\{(\text{the maximum length})^2/(\text{an area})\}\times(\pi/4)\times 100$ wherein the maximum length is a mean value of maximum lengths in projected images of particles and an area is a mean value of projected areas of particles and wherein $SF2=\{(\text{a circumferential length})^2/(\text{an area})\}\times\{100/(4\pi)\}$ wherein a circumferential length is a mean value of circumferential lengths in projected images of particles and an area is a mean value of projected areas of particles, which minute particles have a multi-point contact with the surface of the photosensitive member sufficient to scrape off said surface thereof.

2. An image forming apparatus as claimed in claim 1, wherein the minute particles in the toner rub the surface of the photosensitive member.

3. An image forming apparatus as claimed in claim 1, wherein the toner is composed of resin and minute particles, the toner containing 0.1–40 weight parts of the minute particles with respect to 100 weight parts of the resin.

4. An image forming apparatus as claimed in claim 1, wherein the minute particles are magnetic particles.

5. An image forming apparatus as claimed in claim 1, wherein the octahedron shape has a face contact or a crest line contact with the surface of the photosensitive member.

6. An image forming apparatus comprising:

a photosensitive member having an amorphous carbon layer on an outer surface thereof; and a developing device accommodating a toner and a carrier for use of developing an electrostatic latent image formed on the surface of the photosensitive member, said carrier comprising minute particles each of which has a size of 200 μm or less and at least one of an octahedron shape and an irregular shape, having a ratio of 1/R exceeding 10 in less than 80% of the particles on the basis of the total number of minute particles wherein 1 is the maximum length of a particle and R is a diameter of a column having the longest portion of the particle as a central axis, and having a shape coefficient SF1 smaller than 120 and a shape coefficient SF2 smaller than 110 in less than 80% of the particles on the basis of the total number of minute particles wherein $SF1=\{(\text{the maximum length})^2/(\text{an area})\}\times(\pi/4)\times 100$ wherein the maximum length is a mean value of maximum lengths in projected images of particles and an area is a mean value of projected areas of particles and wherein $SF2=\{(\text{a circumferential length})^2/(\text{an area})\}\times\{100/(4\pi)\}$ wherein a circumferential length is a mean value of circumferential lengths in projected images of particles and an area is a mean value of projected areas of particles, which minute particles have a multi-point contact with the surface of the photosensitive member sufficient to scrape off said surface thereof.

7. An image forming apparatus as claimed in claim 6, wherein the minute particles in the carrier sweep the surface of the photosensitive member.

8. An image forming apparatus as claimed in claim 6, wherein the carrier is composed of resin and minute particles, the carrier containing 200–600 weight parts of the minute particles with respect to 100 weight parts of the resin.

9. An image forming apparatus as claimed in claim 6, wherein the octahedron shape has a face contact or a crest line contact of the minute particles with the surface of the photosensitive member.

10. An image forming apparatus as claimed in claim 6, wherein the minute particles are magnetic particles.

11. A method for treating a photosensitive member having an amorphous carbon layer on an outer surface thereof and provided in an image forming apparatus comprising the steps of:

supplying a member including minute particles; and rubbing the surface of the photosensitive member by means of said member comprising minute particles each of which has a size of 200 μm or less and at least either an octahedron shape and an irregular shape, having a ratio of 1/R exceeding 10 in less than 80% of the particles on the basis of the total number of minute particles wherein 1 is the maximum length of a particle and R is a diameter of a column having the longest portion of the particle as a central axis, and having a shape coefficient SF1 smaller than 120 and a shape coefficient SF2 smaller than 110 in less than 80% of the particles on the basis of the total number of minute particles wherein $SF1=\{(\text{the maximum length})^2/(\text{an area})\}\times(\pi/4)\times 100$ wherein the maximum length is a mean value of maximum lengths in projected images of particles and an area is a mean value of projected areas of particles and wherein SF2={(a circumferential length)$^2$/(an area)}×{100/(4π)} wherein a circumferential length is a mean value of circumferential lengths in projected images of particles and an area is a mean value of projected areas of particles, which minute particles have a multi-point contact with the surface of the photosensitive member sufficient to scrape off said surface thereof.

12. A method as claimed in claim 11, wherein the octahedron shape has a face contact or a crest line contact with the surface of the photosensitive member.

13. An image forming apparatus as claimed in claim 11, wherein the minute particles are magnetic particles.

14. An image forming apparatus comprising:

a photosensitive member having an amorphous carbon layer on a surface thereof;

a developing device accommodating a toner for developing an electrostatic latent image formed on the surface of the photosensitive member; and a cleaner for cleaning a residual toner on the surface of the photosensitive member, said cleaner including minute particles each of which has a size of 1.0 μm or less and at least one of an octahedron shape and an irregular shape having a ratio of 1/R exceeding 10 in less than 80% of the particles on the basis of the total number of minute particles wherein 1 is the maximum length of a particle and R is a diameter of a column having the longest portion of the particle as a central axis, and having a shape coefficient SF1 smaller than 120 and a shape coefficient SF2 smaller than 110 in less than 80% of the particles on the basis of the total number of minute particles wherein SF1={(the maximum length)$^2$/(an area)}×(π/4) 100 wherein the maximum length is a mean value of maximum lengths in projected images of particles and an area is a mean value of projected areas of particles and wherein SF2={(a circumferential length)$^2$/(an area)}×(100/(4π)} wherein a circumferential length is a mean value of circumferential lengths in projected images of particles and an area is a mean value of projected areas of particles, which minute particles have a multi-point contact with the surface of the photosensitive member sufficient to scrape off said surface thereof.

15. An image forming apparatus as claimed in claim 14, wherein the magnetic particles in the cleaner rubs the surface of the photosensitive member.

16. An image forming apparatus as claimed in claim 14, wherein the cleaning means is a magnetic brush cleaner.

17. An image forming apparatus as claimed in claim 14, wherein the octahedron shape has a face contact or a crest line contact with the surface of the photosensitive member.

18. An image forming apparatus as claimed in claim 14, wherein the cleaner is composed of resin and the magnetic particles, the cleaner having 200–600 weight parts of the magnetic particles with respect to 100 weight parts of the resin.

* * * * *

UNITED STATES PATENT AND TRADEMARK OFFICE

CERTIFICATE OF CORRECTION

PATENT NO. : 5,396,317

DATED : March 7, 1995

INVENTOR(S) : Izumi OSAWA et al

It is certified that error appears in the above-indentified patent and that said Letters Patent is hereby corrected as shown below:

On the title page, please insert:

-- [30] Foreign Application Priority Data

February 7, 1990 [JP] Japan ..... 02-027868 --.

Signed and Sealed this

First Day of August, 1995

Bruce Lehman

*Attest:*

BRUCE LEHMAN

*Attesting Officer*

*Commissioner of Patents and Trademarks*